United States Patent [19]

Reyner

[11] Patent Number: 4,645,078

[45] **Date of Patent: * Feb. 24, 1987**

[54] TAMPER RESISTANT PACKAGING DEVICE AND CLOSURE

[76] Inventor: Ellis M. Reyner, 1050 George St., Ste. 16 H, New Brunswick, N.J. 08901

[ * ] Notice: The portion of the term of this patent subsequent to Mar. 13, 2001 has been disclaimed.

[21] Appl. No.: 588,897

[22] Filed: Mar. 12, 1984

[51] Int. Cl.[4] ..... B65D 81/20; B65D 85/86; G01L 19/12

[52] U.S. Cl. ..... 206/524.8; 206/216; 206/457; 206/807; 150/55; 215/1 C

[58] Field of Search ..... 206/524.8, 216, 45.33, 206/45.34, 457, 497, 807; 215/1 C, 5

[56] References Cited

U.S. PATENT DOCUMENTS

| | | | |
|---|---|---|---|
| 2,224,296 | 12/1940 | Hoffman | 220/DIG. 19 |
| 2,685,316 | 8/1954 | Krasno | 229/17 R |
| 2,777,125 | 1/1957 | Weisse | 220/231 |
| 3,133,664 | 5/1964 | Koch | 220/231 |
| 3,358,415 | 12/1967 | Kurfirst | 206/524.8 |
| 3,686,782 | 8/1972 | Erickson et al. | 206/522 |
| 4,436,203 | 3/1984 | Reyner | 206/807 |
| 4,449,631 | 5/1984 | Levenberg et al. | 206/522 |
| 4,449,632 | 5/1984 | Marusiak, Jr. | 206/524.8 |

*Primary Examiner*—Joseph Man-Fu Moy
*Attorney, Agent, or Firm*—Richard H. Stern

[57] ABSTRACT

A packaging device consisting of at least one enclosure containing the product and at least one flowable material of predetermined quantity, closed by at least one airtight closure, at least one portion of the walls of said enclosure and closure is flexible. In the event the product is tampered with through an opening in the walls of said packaging device, the package will manifest evidence which will alert the consumer of the possibility that the product may have been tampered with. Statements for identifying evidence of tampering with the package and cautioning the purchaser against utilizing the contents therein appear on said package.

6 Claims, 22 Drawing Figures

FIG. 1
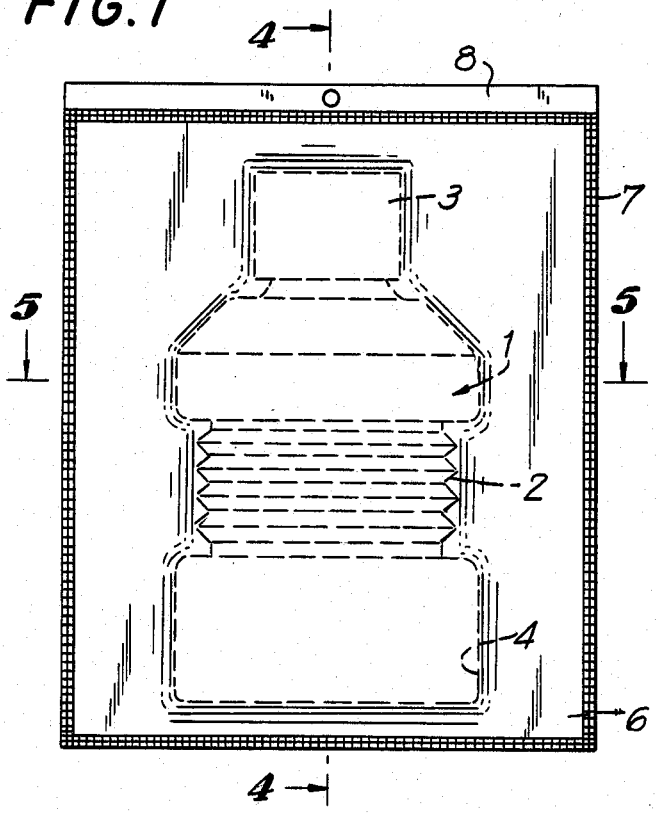
FIG. 4
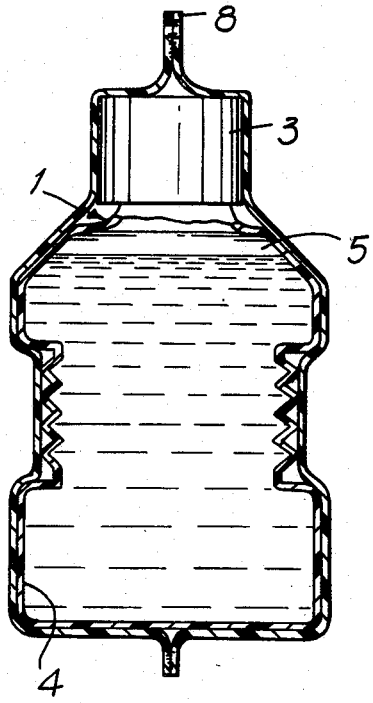
FIG. 5
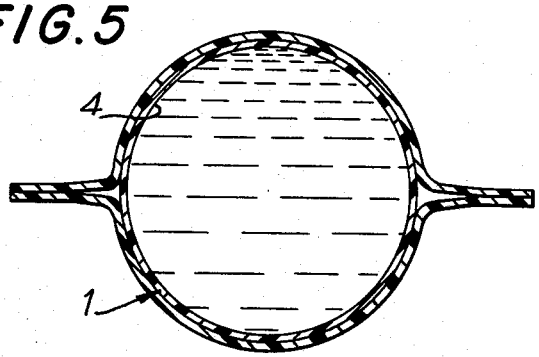
FIG. 2
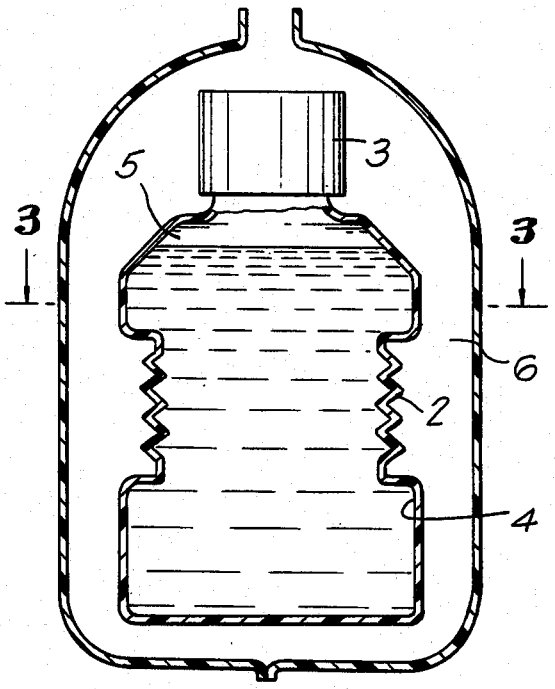
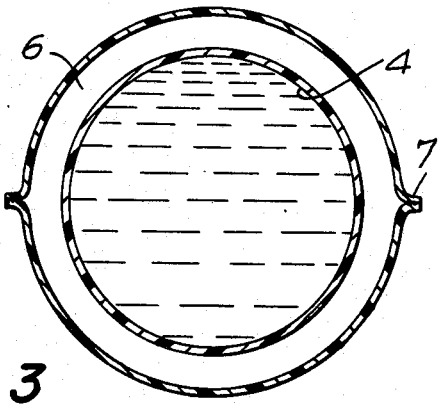
FIG. 3

FIG. 10
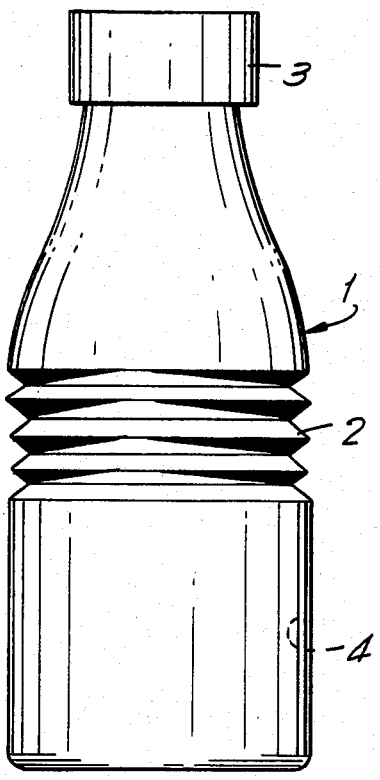
FIG. 16
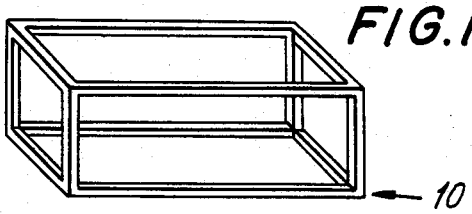
FIG. 11
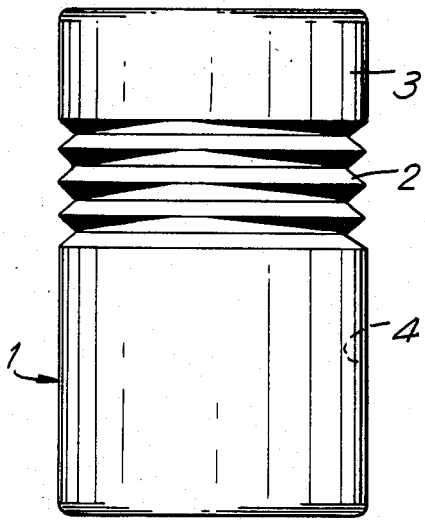
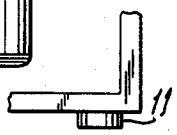
FIG. 17
FIG. 12
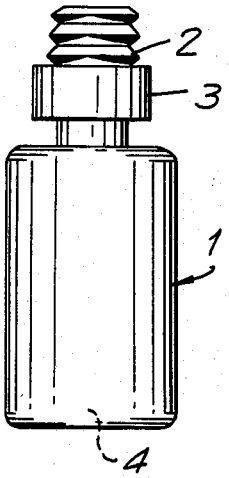
FIG. 13
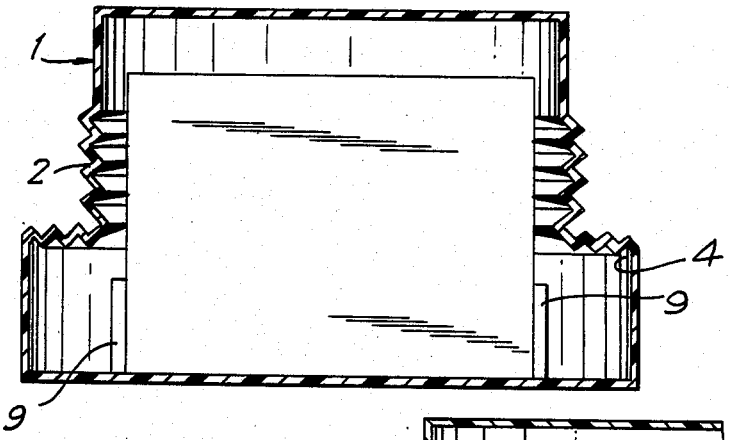
FIG. 14
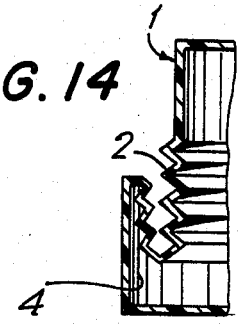
FIG. 15
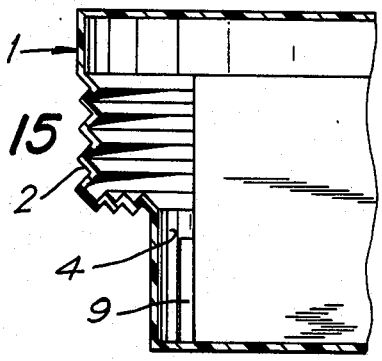

1
3
12
13
14
15
16
17
18

TAMPER RESISTANT PACKAGING DEVICE AND CLOSURE

BACKGROUND OF THE INVENTION

For some time, there has been a need for tamper-resistant packaging devices and processes for consumer products which have features capable of alerting the consumer in the event that there is a possibility that the contents therein may have been tampered with after manufacturing.

The need for a practical and economical tamper resistant packaging device has now become a necessity in our lives more than ever before.

A common problem with the so called "Tamper Resistant Packaging" which are currently on the market is that even though products are packaged in shrink wrap, strip-pack, or blister pack, they can be tampered with through a small aperture opened in the walls of the package by means of thin hypodermic needles or the like, or by dissociating the adhesive seals of the package. Such a small aperture in the conventional packages cannot be readily detected by the inexperienced eye of the average consumer, who may be inexperienced in recognizing packaging imperfections of this sort. The present invention provides packaging which overcomes the above mentioned deficiencies of the prior art and provides additional novel features and advantages, and a wider range of uses than were possible with devices used heretofore. One recent development that has apparently solved the above problem and achieved substantial success is the invention disclosed and claimed in U.S. patent application Ser. No. 06/493, 363, filed on May 10, 1983, invented by the common inventor and owned by the same assignee. The status of this U.S. patent application at this time is that it has been allowed, but it has not been issued or published at the date of filing this patent application in the U.S. Patent Office. The latter invention utilizes an enclosure and a closure holding the product therein and means for making available therein higher pressure than that in the surrounding atmosphere. The above mentioned enclosure and closure may be enclosed within an outer enclosure and closure which contain a predetermined quantity of flowable material. Changes in the characteristics of the package due to the flow of the flowable material into or from said package indicate the possibility that the package had been tampered with.

The present invention is a further extension of the latter concept providing greater utility and flexibility in functions, designs, constructions and the processing of tamper resistant type packaging and permits additional techniques which have not been disclosed in the prior application.

BRIEF SUMMARY OF THE INVENTION

Packaging means capable of manifesting evidence of tampering therewith in the event that at least one aperture is made in its walls, said packaging means comprising an enclosure of suitable size, design and construction which holds the product and means therein cause changes in the characteristics of said package due to disturbance generated in its internal pressure characterized by higher or lower pressure than the surrounding atmospheric pressure, instructions associated with said package alert the purchaser to the possibility that said changes in the package may indicate that the product therein may have been tampered with and caution against utilizing said product.

One object of this invention is to make available a packaging device which forms a barrier to entry to the product and would manifest evident changes to alert and caution the purchaser against utilizing the product in the event that the package was tampered with.

Another object of the present invention is to provide a practical and economical tamper-resistant packaging which can be utilized in various packaging sizes and designs.

Another object of the present invention is to provide a practical and economical tamper-resistant packaging device and packaging process which take into consideration consumers with certain problems such as arthritis.

A further object of this invention is to provide practical and economical tamper-resistant device which is more effective than those originally suggested by the FOOD AND DRUG ADMINISTRATION (FDA).

Another object of this invention is to manufacture and supply said packaging device to marketers.

Another object of this invention is to package products within an economical and effective tamper-resistant packaging which can be offered to the public at reasonable prices.

Other objects of the precise nature of the present invention will become evident from the following description and accompanying drawings in which each of the various components have the same reference numeral in the different views.

DESCRIPTION OF THE DRAWINGS

FIG. 1 is a front view of the tamper-resistant package including inner enclosuer (1), and shows bellows shaped foldings (2) section of the walls of internal enclosure (1), which is enclosed within outer enclosures (7).

FIG. 2 is a vertical section of FIG. 1 showing an open outer flexible bag (7) enclosing an inner enclosure (1) and its interior (4) and a wide space between them. Enclosure (1) has extendable bellows shaped foldings (2) in a portion of its walls.

FIG. 3 is a horizontal section of FIG. 1 at a certain level showing internal enclosure (1) inside outer enclosure (7) before it is closed, and space (6) is between them.

FIG. 4 is a vertical section of this package showing outer flexible bag (7) closed after it was properly evacuated and its internal pressure is reduced below that of the surrounding atmosphere, and the size of space (6) is reduced in comparison to the size shown in FIG. 2.

FIG. 5 is a horizontal section of FIG. 4 showing the size of space (6) reduced in comparison to that shown in FIG. 3 after outer enclosure (7) has been properly evacuated and closed.

FIGS. 6,7,8,9,10,11, and 12 are front views of other embodiments of the invention illustrating alternative shapes and sizes of internal enclosure (1) including the possible sizes and locations of the bellows shaped foldings (2) which may also be integrated in closure (3).

FIG. 13 is a vertical sectional view of another embodiment of the invention illustrating another variation in the design and construction and location of the pleats of the bellows shaped section (2) of inner enclosure (1), cushions (9), associated with enclosure (1), are suitably designed to hold the product within a predetermined space therein.

FIG. 14 is a schematic vertical sectional view of another embodiment of the invention illustrating the bellows shaped foldings (2) designed to settle within enclosure (1) when compressed.

FIG. 15 is a schematic vertical sectional view of another embodiment of the invention illustrating the bellows shaped foldings (2) designed to settle outside enclosure (1) when it is suitably compressed.

FIG. 16 is a schematic view illustrating a skeleton framework structure (10).

FIG. 17 is a schematic vertical sectional view illustrating one bulge (11) on skeleton structure (10).

Figure 6:
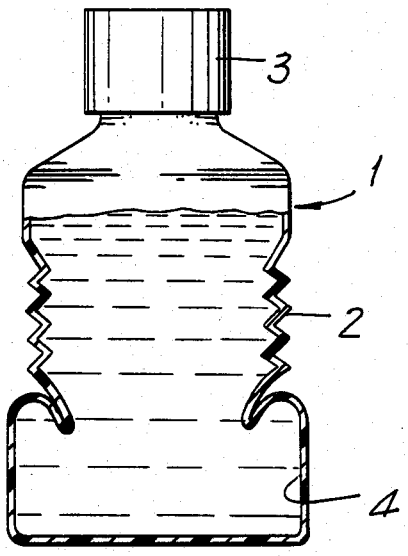
Figure 7:
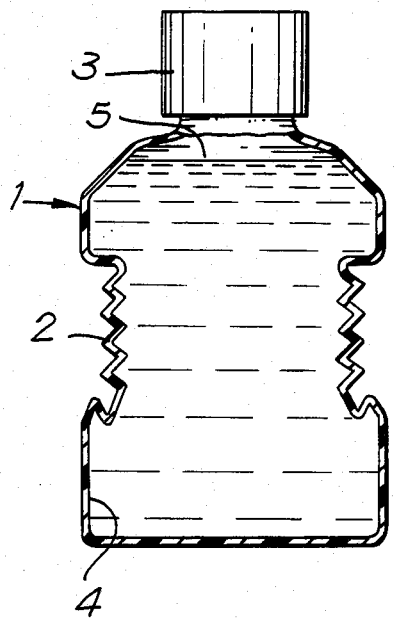
Figure 8:
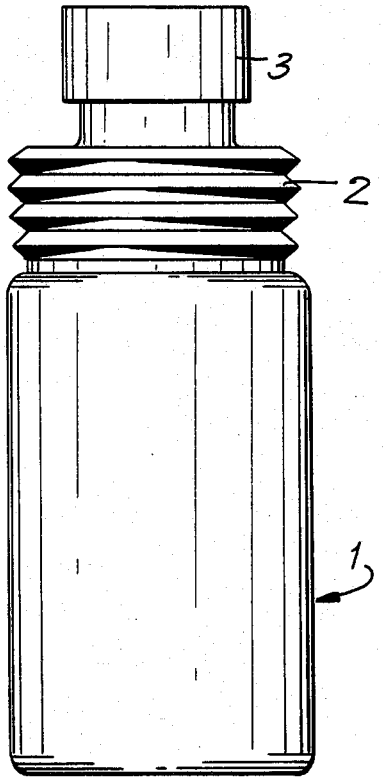
Figure 9:
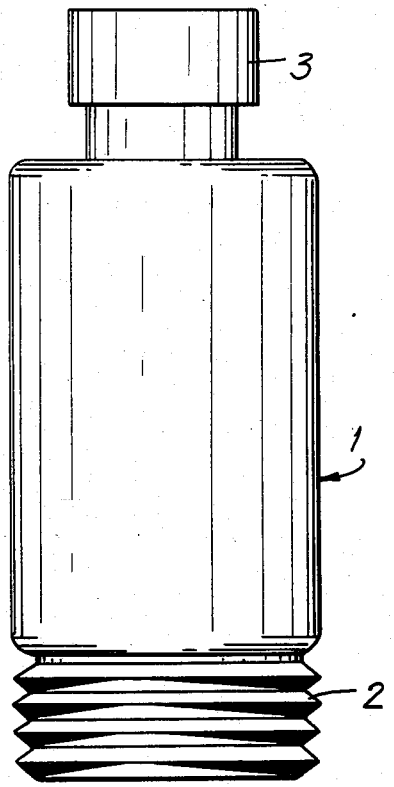

Not shown in the drawings is still another embodiment of the invention wherein enclosure (1) and closure (3) are joined together by crimping rather than by threading.

Each of the various components in the various figures and views have the same reference numerals as in FIGS. 1 to 22.

DETAILED DESCRIPTION

The illustrative embodiment of FIG. 1 comprises an enclosure (1) of any suitable design, shape, construction and size, and is closed with closure (3) which is of the type of child resistant closure. At least a portion of the walls of at least one of enclosure (1) and closure (3) is flexible and suitably foldable and is of suitable size and design which may resemble the shape of bellows-like (2). The contents of the interior space (4) inside enclosure (1) may be solid, semi-solid, liquid or gaseous material, and above it is head space (5). A specified quantity of at least one specific flowable material in enclosure (1) after it is hermetically closed is instrumental in determining its volume under the pressure and temperature of the surrounding atmosphere by folding or unfolding bellows-like foldings (2). The bellows shaped foldings (2) associated with enclosure (1) and closure cap (3) are capable of holding a predetermined quantity of at least one flowable material which is capable of causing the internal pressure therein to reach a predetermined range of pressure level when said bellows shaped foldings are conveniently compressed. Outer flexible pouch-like enclosure (7) is made of any suitable size, shape and construction and encloses enclosure (1) and forms space (6) in between, and holds a predetermined quantity of at least one specific flowable material which may be liquid or gas or both liquid and gas and is hermetically sealed at area (8). The internal pressure within enclosure (7) may be above or below that of the surrounding atmospheric pressure, and is determined by the quantity of the flowable material therein. Enclosure (1) and enclosure (7) are capable of maintaining their predetermined volume and internal pressure under the same atmospheric conditions within an acceptable degree of accuracy as long as they remain closed and untampered with.

Shown in FIGS. 2 and 3 are enclosure (7) in an open position, the contents in space (4) is liquid and on top of it is head space (5) which contains gas. The walls of outer enclosure (7) do not press against the walls of the inner enclosure (1), and do not restrict its movement therein.

Shown in FIGS. 2 and 3 are enclosure (7) in an open position, the contents in space (4) is liquid and on top of it is head space (5) which contains gas. The walls of outer enclosure (7) do not press against the walls of the inner enclosure (1), and do not restrict its movement therein.

In the illustrative embodiments of FIGS. 4 and 5, enclosure (7) which encloses enclosure (1) has been evacuated and its internal pressure has been suitably reduced to a level below that of the surrounding atmospheric pressure before it was permanently closed. The partial vacuum within outer enclosure (7) would confine and seize and cushion structure (10) and inner enclosure (1) and restrain and limit their movement therein to a predetermined degree. Its walls touch and press against the walls of the inner enclosure (1). The movement of enclosure (1) within enclosure (7) is restricted to a predetermined degree.

Figures 18, 19, 20, 21, 22:
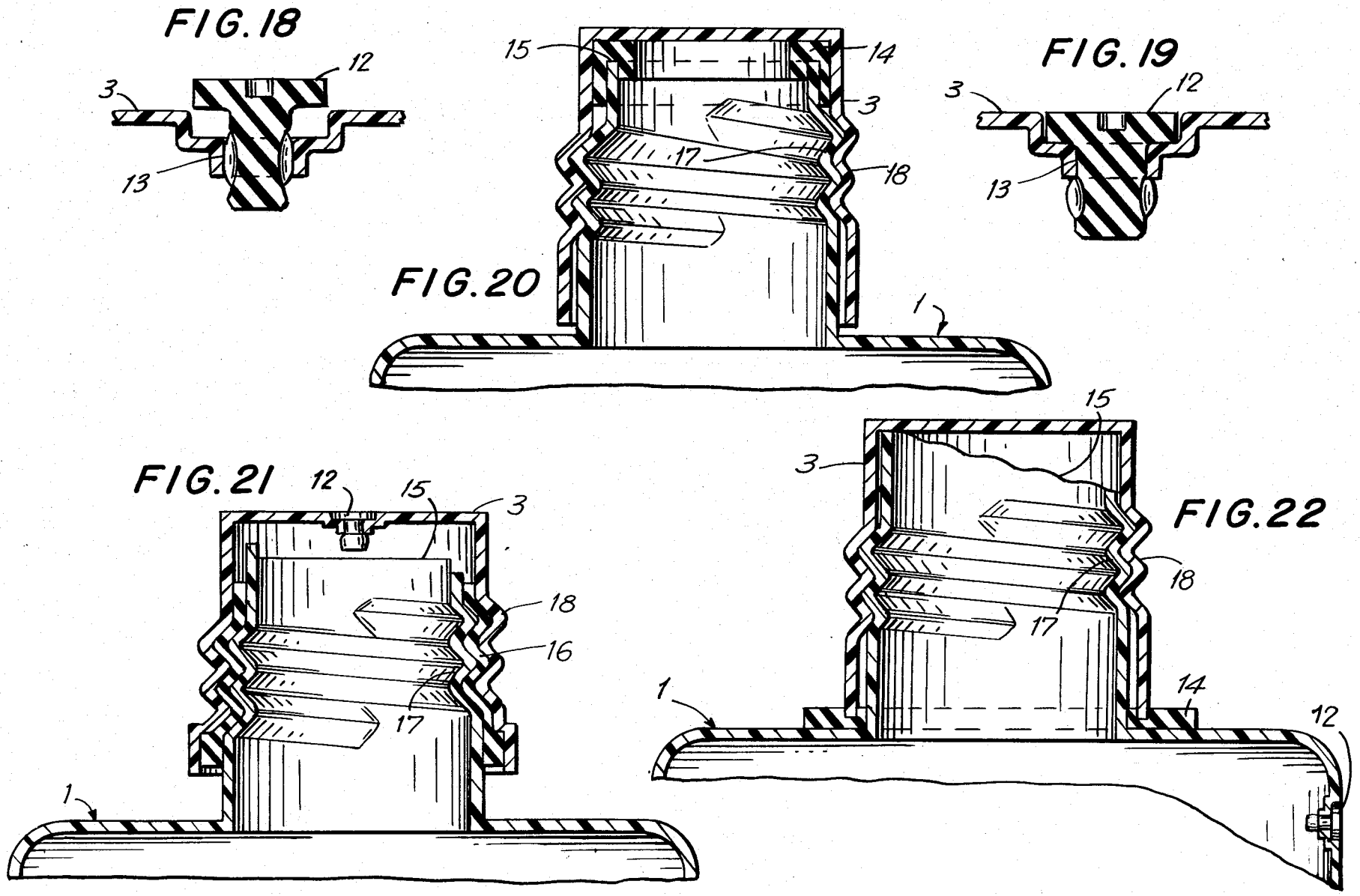
FIG. 18 is a schematic vertical sectional view of an open and shut plug with plug piece (12) extending through opening (13), grooves on the surface of plug (12) allow the flow of flowable materials through opening (13) when plug piece (12) is in an open position.
FIG. 19 is a schematic vertical sectional view of an open and shut plug with plug piece (12) moved into a locked-in closed position to hermetically seal opening (13) in an air tight condition.
FIG. 20 is a vertical, sectional view of another embodiment of the invention illustrating a different shape for the neck of enclosure (1) closed by a closure screw cap (3) and gasket (14) held in an air tight condition between the interior of screw cap (3) and the edge of opening (15) in the neck of enclosure (1) and hermetically seals it. Opening (15) is of circular shape and an even surface.
FIG. 21 is a vertical, sectional view of another embodiment of the invention illustrating a different shape for the neck of enclosure (1) closed by a closure screw cap (3) and flowed in gasket (16) held in air tight condition between threading (18) in the interior of screw cap (3) and threading (17) around the neck of enclosure (1) and seals it hermetically. Opening (15) is of an irregular shape and even surface. At least one open and shut plug with plug piece (12) is located in the wall of at least one of closure (3) and enclosure (1) and allows the flow of a specified flowable material in or out of enclosure (1) when said plug piece (12) is in an open position.
FIG. 22 is a vertical sectional view of still further embodiment of the invention illustrating another different shape for the neck of enclosure (1) containing the product and closed by a closure screw-cap (3) and gasket (14) held in air tight condition between the base of screw cap (3) and around the neck over the shoulder of enclosure (1) and hermetically seals it. Opening (15) is of an irregular shape and uneven surface. At least one open and shut plug and plug piece (12) in an open position located in the wall of enclosure (1) allows the flow of a specific flowable material in or out of said enclosure (1), and in the process thereafter plug piece (12) is moved to a closed locked-in position and hermetically seals enclosure (1) in an air tight condition.

The illustrative embodiments in FIGS. 6,7,8,9,10,11,12,13,14, and 15 show variations of containers and closures which conform with all the specifications of the inner enclosure (1) and closure (3) mentioned above. At least one of the bellows-like foldings (2) in either container (1) or closure (3) can be suitably compressed and result with raising its internal pressure and reducing its size. Foldings (2) may be constructed in various suitable designs, sizes and locations, and compressed to settle on top of one another as in FIGS. 7,8,9,10,11, and 12, or settle within the container as in FIGS. 6,13, and 14, or outside the container as shown in FIG. (15). The illustrative embodiment of FIG. 18 shows an open and shut plug with plug piece (12) of a special design, size, dimensions and construction and is in an open position extending through opening (13) in enclosure (1). Part of plug piece (12) which extends through opening (13) into the interior of enclosure (1) is narrower than opening (13) and has grooves indented on its surface which allows a specific flowable material to flow around it through opening (13) and subsequently in or out of enclosure (1). The tip of plug piece (12) which protrude in the interior inside enclosure (1) is larger than opening (13) and does not allow said plug piece (12) to slip or come out by itself through opening (13).

The illustrative embodiment of FIG. 19 shows an open and shut plug with plug piece (12) of a special design, size, dimensions and construction closed in locked-in position, pushed inside enclosure (1) through opening (13) and sealing opening (13) hermetically in an air tight condition. Plug piece (12) becomes locked-in by opening (13) due to their special design, dimensions and construction. Because of the elasticity of part of plug piece (12), after it is squeezed through opening (13) to protrude into the interior of enclosure (1), it will assume its original size, which is larger than opening (13) and locks in itself in that position.

The illustrative embodiment of FIG. 20 shows gasket (14) pressed between the opening of enclosure (1) and closure (3) in a hermetically air tight seal.

The illustrative embodiment of FIG. 21 shows flowed-in gasket (16) pressed between the threadings of the neck of enclosure (1) and those of closure (3) in a hermetically sealed air tight condition. Opening (13) and plug piece (12) are located in the wall of closure (3). The illustrative embodiment of FIG. 22 shows gasket (14) pressed between the open end of closure (3) and the shoulder of enclosure (1) in hermetically sealed air tight condition. Opening (13) and plug piece (12) are located in the wall of enclosure (1).

The combinations of the open and shut plug, plug piece (12) and opening (13) may be located in any of the walls of enclosure (1) and closure (3).

Packaging a product in a tamper-resistant packaging system of this type involves the following steps:

I. Transfer the required quantity of the product into enclosure (1).

II a. Transfer a predetermined quantity of the specified flowable material into enclosure (1) and close it by closure (3) in a hermetically air tight condition.

II b. In case where open and shut plug including plug piece (12) and opening (13) are associated with the wall of either enclosure (1) or closure (3) as specified above, enclosure (1) may first be closed by closure (3) in an air tight condition and thereafter the specified predetermined quantity of the flowable material content in enclosure (1) is adjusted to conform with the specification data. This adjustment of the contents in enclosure (1) is done while plug piece (12) is in an open position, and thereafter it is pushed to a closed locked-in position as specified above.

III. In case there is another enclosure such as outer enclosure (7) associated with the package, then enclosure (1) described above is placed within enclosure (7), and a predetermined quantity of the specified flowable content therein is adjusted before enclosure (7) is closed hermetically in an air tight condition.

In case the internal pressure level within enclosure (7) is below that of its surrounding atmospheric pressure, the walls of enclosure (7) will press against the walls of enclosure (1) therein and restrict and limit its movement to a predetermined degree.

The transfer of the flowable material to and from enclosure (1) and joining said enclosure (1) with closure (3) require special equipment, among which is a suitable adapter. At least one of said members, namely enclosure (1), closure (3), said adapter and equipment may be constructed according to specific designs, dimensions, construction, indentations and markings which may be utilized as proprietary.

In another embodiment, the inner enclosure (1) which holds the product as described above is lodged within a skeleton framework structure means (10) which is illustrated in Fig. (16). An oversize flexible outer enclosure (7) envelopes structure (10) including enclosure (1) and is closed by means of suitable closing device after adjusting the quantity of its contents. At least one bulge (11) extends from skeleton framework structure type (10) at a convenient location as shown in Fig. (17).

In the event that the internal pressure in outer enclosure (7) is reduced to a predetermined pressure level below that of the surrounding atmosphere during the manufacturing process, parts of the flexible walls of oversize enclosure (7) would be sucked in within the extremeties and reaches of bulges (11) and structure (10), and thus allow the manufactured package to assume nearly uniform shapes which may allow them to be stacked up.

The partial vacuum within outer enclosure (7) would confine and seize and cushion structure (10) and inner enclosure (1) and restrain and limit their movement therein to a predetermined degree.

In another embodiment of tamper-resistant packaging not shown in the drawings, flexible enclosure means (1) which holds the product is suitably pressurized to a predetermined pressure level above that of the surrounding atmosphere with at least one suitable flowable material and is fitted with a closure member (3) of the type referred to in the trade as "Child-resistant closure", or it is fitted with closure means replaceable by such child-resistant closure means. Under normal temperatures and pressures, and whether it is closed or opened, the unpressurized flexible enclosure means (1) which holds the product, has the characteristics whereby upon applying on the exterior of its walls a predetermined pressure within a range equivalent to that of a human hand squeeze, it becomes soft, flexible and yields or caves in, and at least one of the following will occur:

A. At least one portion of the walls will yield.

B. At least one section of the walls will cave in.

C. At least one section of the walls will be damaged.

D. The size of inner enclosure (1) will be reduced.

Under normal temperatures and pressures, the pressurized flexible enclosure means (1) which holds the product has the characteristics whereby upon applying on the exterior of its walls a predetermined pressure within the range equivalent to that of human hand squeeze, no portion of its exterior walls will yield or cave in, to the same degree mentioned above and the enclosure remains rigid and inflexible to the same degree as manifested by such packages which are properly manufactured, and the pressurizing flowable material remains therein.

In another embodiment not shown in the drawings the enclosure which holds the product or the encased product has an internal pressure below that of the surrounding atmosphere.

Outer enclosure (7) is made of any suitable size, design, shape and markings, and is constructed from at least one or more suitable materials which may be rigid, semi-rigid, flexible, metal alloy, metallic foils, glass, fibre-glass, cardboard, cork, plastic-like cured rubber, rubber, impervious, non-impervious, permeable, non-permeable, stretchable, non-stretchable, laminated, non-laminated, elasticated, non-elasticated, lined, non-lined, multi-film, single film, with or without foil, single layer, multi-layer, specially treated or non-treated fabric, or any other suitable materials which may be available on the market, and at least one portion of the walls of said enclosure (7) is conveniently flexible.

Inner enclosure (1) is of any suitable size, design, shape and markings, and is constructed from one or more suitable materials of the type specified for the construction of outer enclosure (7). At least a portion of its walls may be flexible and may be foldable. The folds may be of any suitable size, design, shape and construction and may assume the form of bellows. The interior (4) of inner enclosure (1), which holds the product may be suitably shaped to cushion and restrict the movement of its content to a predetermined degree within a limited space.

Bellows (2) may be of any suitable size, shape, design and capacity, and can be conveniently stretched to increase the holding capacity of enclosure (1) in excess of a predetermined size, and when compressed, it should cause the internal pressure of enclosure (1) to rise above a predetermined pressure level and enables the package to perform properly. Said bellows are constructed from at least one suitable flexible material which conforms with the specifications of the flexible materials associated with enclosure (1) mentioned above. Closure means (3) of enclosure (1) may be of any suitable size, design, or shape, removeable, replaceable, permanent, with or without bellows, and it may conform with the specifications of what is known in the trade to be "Child-resistant closure", or it may be replaceable by a child-resistant closure means. It is constructed from one or more suitable materials such as those specified for the construction of inner enclosure (1).

Permanent closing device means associated with enclosure (7) at area (8), which may also be associated with enclosure (1), may be any suitable process such as crimping, fusing, welding, heat sealing, gluing or others.

The flowable material loaded into enclosure (1) which contains the product or into outer enclosure (7) is constituted from at least one single chemical entity or from a mixture of single chemical entities which may be in a state of gas or in a state of liquid, or in the state of a combination of both gas and liquid under the pressure and temperature conditions which said package would exist and would be handled during manufacturing, distribution and retail display. The flowable material should not constitute part of the finished product or related to or constitute any of its ingredients or contribute or add or reduce or modify or alter any of its physical or chemical characteristics, such as color, odor, taste, consistency or texture or any other characteristics for which the product is intended to be utilized. In the event that the product itself has the characteristics which enables it to perform the functions of the flowable material, an additional flowable material may not be required.

Each of plug piece (12), gasket (14), and flowed-in gasket (16) is constructed from any suitable material, design, size and shape for carrying out properly its specified functions, and when in open position each is capable of allowing the flow of specific flowable material, and when closed each becomes hermetically sealed in air tight condition. The construction material may be selected from materials or combinations of materials such as elasticated rubber, cured rubber, plastics, cork, cardboard, treated or non-treated fabric among others including those materials of the type specified for the construction of outer enclosure (7).

Skeleton framework structure means (10) is of any suitable size, shape and design, and constructed from one or more suitable materials such as those specified for the construction of outer enclosure (7), and is capable of supporting the outer flexible (7) under the surrounding atmospheric pressures and temperatures, and continues to do so during manufacturing, distribution and retail display. Skeleton framework means (10) may constitute an integral part of enclosure (1). At least one bulge (11) is located on the exterior surface of skeleton framework means (10), which may be an integral part of it. One or more of skeleton framework structure (10) may be located in one or more locations in this packaging system such as the locations inside or outside enclosure (1) and the locations inside or outside enclosure (7).

This packaging system has at least one distinguishing proprietary means which may be associated with its shape, design, markings, or graphic characteristics such as a trade mark or a logo which is not readily available on the market, and which provides an indication of package integrity and remains intact during manufacturing, distribution and retail display. Their distinguishing proprietary means is associated with the barrier to entry to the product, and if destroyed, broken, breached, or missing, it can easily be expected to provide visual, mechanical, odorous, or any other means of evidence to indicate to the consumer that tampering with the product may haVe occured.

This package may contain a statement prominently placed which remains intact in the event that the package is tampered with, which statement is intended to alert the consumer to the specific tamper-resistant features which would indicate the possibility that tampering may have occured, and recommends against purchasing that particular package.

The flowable material as well as all the other component parts of this tamper-resistant packaging means may be of the type which can be sterilized.

In the event the contents of enclosure (1) is tampered with through at least one aperture made in each of enclosure (1) and also in enclosure (7) whenever the latter is utilized in this packaging system, both of the predetermined volume and the predetermined presssure in enclosure (1) and enclosure (7) or at least in one of them will be disturbed, and cause the package to manifest at least one of the following indications, which would serve to caution the consumer of the possibility that the package had been tampered with:

1. When said package is subjected to a predetermined pressure level equivalent to that of a human hand squeeze on the exterior of its walls, at least one of the following results would be manifested:
   a. At least a portion of its walls would yield.
   b. At least a portion of its walls would cave in.
   c. At least a portion of its walls would be damaged.

d. The size of the enclosure which holds the product will be reduced and its internal pressure will rise and upon freeing it from said pressure, it will not regain its original capacity.

e. The internal pressure in the outer enclosure (7) will change.

f. The volume and pressure of said outer enclosure (7) will change.

2. Upon pulling outwardly at least a portion of the walls of the package, said outer enclosure grows in size and would not be restored to its original smaller capacity when said outwardly pulling stops.

3. The inner enclosure which contains the product would move within the outer enclosure easily and freely beyond the predetermined extent of the movement of its counterpart in a properly manufactured package which has not been tampered with.

4. Discharge of the package contents out of outer enclosure (7) or inner enclosure (1) or out of both enclosures may become evident.

5. At least one of the characteristic color, odor, design or texture of the package will change.

The radio-activity of the materials utilized in the component parts of this tamper-resistant packaging system should be within human tolerance.

While certain illustrative embodiments of the invention have been described in particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

What is claimed is:

1. In a tamper-resistant package type, a flexible enclosure means fitted with closure means holding at least one flowable material including the product, the internal pressure in said flexible enclosure means is at a predetermined pressure lever higher than that of its surrounding atmosphere, means associated with said package for manifesting evidence in the event that the contents of the inner enclosure is tampered with through at least one aperture made in said flexible enclosure means, wherein said closure means includes tamper-indicating means.

2. In the combination as defined in claim 1, wherein said tamper-indicating means is an indentation.

3. In the combination as defined in claim 1, wherein said tamper-indicating means is a marking.

4. In a tamper-resistant package type, a flexible enclosure means fitted with closure means holding at least one flowable material including the product, the internal pressure in said flexible enclosure means is at a predetermined pressure level higher than that of its surrounding atmosphere, means associated with said package for manifesting evidence in the event that the contents of the inner enclosure is tampered with through at least one aperture made in said flexible enclosure means, wherein said enclosure means includes tamper-indicating means.

5. In combination as defined in claim 4, wherein said tamper-indicating means is an indentation.

6. In combination as defined in claim 4 wherein said tamper-indicating means is a marking.

* * * * *

UNITED STATES PATENT AND TRADEMARK OFFICE

CERTIFICATE OF CORRECTION

PATENT NO. : 4,645,078.

DATED : February 24, 1987.

INVENTOR(S) : Ellis M. Reyner.

It is certified that error appears in the above-identified patent and that said Letters Patent is hereby corrected as shown below:

CLAIM 1, COLUMN 10, LINE 9, CHANGE "LEVER" TO --LEVEL--
CLAIM 1, COLUMN 10, LINE 12, CHANGE "INNER" TO --SAID--
CLAIM 4, COLUMN 10, LINE 27, CHANGE "INNER" TO --SAID--.

Signed and Sealed this

Nineteenth Day of July, 1988

*Attest:*

DONALD J. QUIGG

*Attesting Officer*

*Commissioner of Patents and Trademarks*